US008948434B2

(12) United States Patent
Godfrey

(10) Patent No.: US 8,948,434 B2
(45) Date of Patent: Feb. 3, 2015

(54) MICROPHONE

(71) Applicant: Michael James Godfrey, Toronto, CA (US)

(72) Inventor: Michael James Godfrey, Toronto, CA (US)

( * ) Notice: Subject to any disclaimer, the term of this patent is extended or adjusted under 35 U.S.C. 154(b) by 0 days.

(21) Appl. No.: 13/925,167

(22) Filed: Jun. 24, 2013

(65) Prior Publication Data

US 2014/0376761 A1 Dec. 25, 2014

(51) Int. Cl.
*H04R 25/00* (2006.01)

(52) U.S. Cl.
USPC ..... 381/362; 381/368

(58) Field of Classification Search
USPC ..... 381/355–356, 360–362, 368, 386
See application file for complete search history.

(56) References Cited

U.S. PATENT DOCUMENTS 3,154,171 A * 10/1964 Knutson et al. ..... 381/368
3,190,972 A 6/1965 Schoeps et al.
3,536,862 A 10/1970 Weingartner
3,585,317 A 6/1971 Dvorsky
3,944,759 A 3/1976 Penning
4,199,667 A * 4/1980 Renner ..... 381/355
4,694,499 A 9/1987 Bartlett
4,836,328 A 6/1989 Ferralli
4,854,415 A * 8/1989 Goschke ..... 381/368
4,862,507 A 8/1989 Woodard
5,042,071 A * 8/1991 Stinauer et al. ..... 381/368
7,013,017 B2 3/2006 Pavlovic
7,366,310 B2 4/2008 Stinson et al.
7,433,484 B2 * 10/2008 Asseily et al. ..... 381/355
7,483,542 B2 * 1/2009 Akino et al. ..... 381/189
7,609,843 B2 * 10/2009 Hatano et al. ..... 381/356
8,189,842 B2 5/2012 Heil
8,406,446 B2 * 3/2013 Akino ..... 381/360
2008/0260194 A1 10/2008 Pooley

* cited by examiner

*Primary Examiner* — Suhan Ni
(74) *Attorney, Agent, or Firm* — Welsh Flaxman & Gitler LLC

(57) ABSTRACT

A microphone includes a housing and a microphone capsule positioned within the housing. The microphone is also provided with a vibration damping, non-porous capsule support member supporting the microphone capsule within the housing and electronic circuitry transmitting the signal from the microphone capsule to other equipment.

17 Claims, 5 Drawing Sheets

MICROPHONE

BACKGROUND OF THE INVENTION

1. Field of the Invention

This invention relates to a microphone.

2. Description of the Related Art

Traditional microphones function by using complex electronics to electronically modify the pickup pattern of the microphone. These microphones commonly employ a housing in which a microphone capsule is positioned for receipt of sound waves. The sound waves are sensed by the microphone capsule, which sends electric signals to the microphone electronics for further processing and transmission to amplification units and/or other sound processing equipment. In addition, the microphone capsules used in conjunction with traditional microphones are delicate and subject to damage during use of the microphone.

As a result of these facts, noise handling characteristics and durability of traditional microphones are compromised. The present invention addresses these shortcomings of prior microphones by providing a mounting system for the secure mounting of a microphone capsule in a manner which dampens vibrations to which the microphone is exposed and offers a mechanism for physically altering and modifying the pickup pattern of the microphone.

SUMMARY OF THE INVENTION

It is, therefore, an object of the present invention to provide a microphone including a housing and a microphone capsule positioned within the housing. The microphone is also provided with a vibration damping, non-porous capsule support member supporting the microphone capsule within the housing and electronic circuitry transmitting the signal from the microphone capsule to other equipment.

It is also an object of the present invention to provide a microphone wherein the housing is a substantially hollow cylindrical member having an open end shaped and dimensioned for receiving the microphone capsule.

It is another object of the present invention to provide a microphone wherein the capsule support member supports the microphone capsule within the open end of the housing.

It is a further object of the present invention to provide a microphone wherein the microphone capsule includes an omni-directional pick-up pattern.

It is also an object of the present invention to provide a microphone wherein the microphone is an electret microphone.

It is another object of the present invention to provide a microphone wherein the capsule support member includes a support member body having a top surface, a bottom surface and a sidewall extending between the top surface and the bottom surface.

It is a further object of the present invention to provide a microphone wherein the capsule support member includes an aperture in which the microphone capsule is mounted.

It is also an object of the present invention to provide a microphone wherein the central aperture extends through the capsule support member such that it extends from the top surface to the bottom surface so that electrical wires may extend from the microphone capsule to the electronic circuitry of the microphone.

It is another object of the present invention to provide a microphone wherein the capsule support member is cylindrical.

It is a further object of the present invention to provide a microphone wherein the top surface is convex.

It is also an object of the present invention to provide a microphone wherein the top surface is concave.

It is another object of the present invention to provide a microphone wherein the top surface is flat.

It is a further object of the present invention to provide a microphone wherein the capsule support member is composed of rubber.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
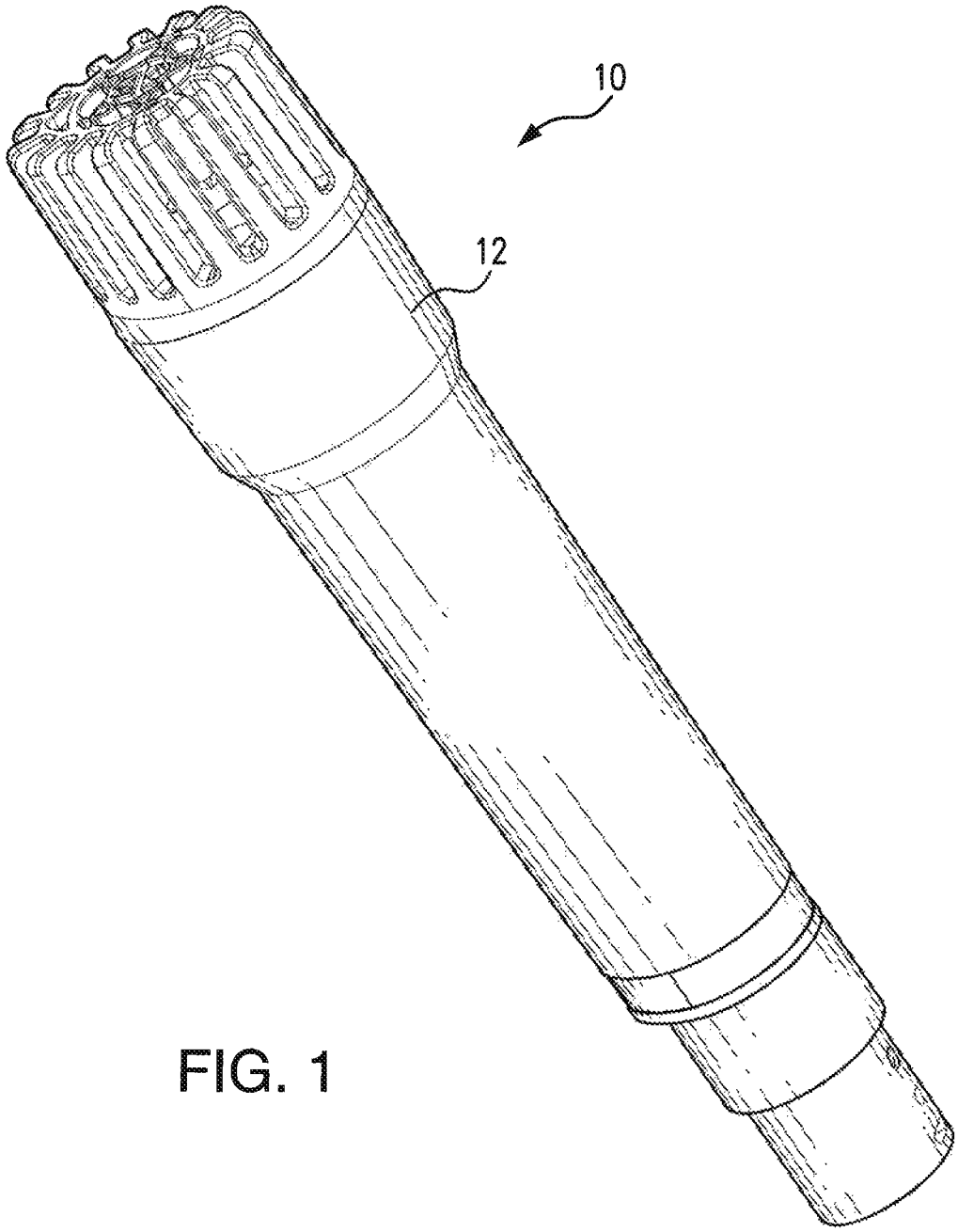
FIG. 1 is a perspective view of a microphone in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Referring to FIGS. 1 to 7, a microphone 10 is disclosed. In particular, the present invention focuses upon a sound focusing and mounting system for microphone capsules and audio sensors. The microphone 10 in accordance with the present invention includes a housing 12 with a grille 13 secured to the upper end of the housing 12. The microphone 10 further includes a microphone capsule 14 positioned within the housing 12, and electronic circuitry 16 transmitting the signal from the microphone capsule 14 to other equipment. It is appreciated the electronic circuitry 16 may be adapted to perform signal processing altering the output of the microphone capsule 14 to the equipment being driven.

In accordance with a preferred embodiment, the housing 12 is a substantially hollow cylindrical member having an open end 18 shaped and dimensioned for receiving the microphone capsule 14. It is appreciated that although a cylindrical housing is disclosed herein with reference to a preferred embodiment, the housing may take various shapes, for example, spherical, without departing from the spirit of the present invention. The microphone capsule 14 is supported by a capsule support member 20. Once the microphone capsule 14 is positioned within the open end 18 of the housing 12, an internal cavity 22 is defined in which the electronic circuitry 16 may be housed. Commonly, the housing 12 includes a hole 24 in its end 26 opposite the open end 18 thereof for the passage of a wire 42 use in connecting the microphone 10 to other equipment.

In accordance with a preferred embodiment, the microphone capsule 14 may take a variety of forms known to those skilled in the art and preferably includes an omni-directional pick-up pattern before installation into the microphone in accordance with the present invention. In accordance with a preferred embodiment, the microphone capsule is a small condenser microphone referred to as electret microphones.

In accordance with a preferred embodiment, the capsule support member 20 is resilient and preferable manufactured from rubber. The capsule support member 20 includes a substantially solid cylindrical support member body 28 having a top surface 30, a bottom surface 32 and a sidewall 34 extending between the top surface 30 and the bottom surface 32. The bottom surface 32 may take a variety of shapes within the spirit of the present invention. As to the top surface 30, it may take three different configurations depending upon the acoustic characteristics desired by the user (see alternate embodiments disclosed with references to FIGS. 2 & 3, FIGS. 4 & 5, and FIGS. 6 & 7.

The top surface 30 is provided with a central aperture 36 in which the microphone capsule 14 is mounted. The central aperture 36 extends through the capsule support member 20 such that it extends from the top surface 30 to the bottom surface 32 so that electrical wires 38 may extend from the microphone capsule 14 to the other electronic circuitry 16 of the microphone 10.

The microphone capsule 14 and the capsule support member 20 provide a forward projecting, omni-directional microphone capsule 14 (or audio sensor) that can be securely mounted in a vibration dampened manner in a handheld or other format whereby the rubber enclosure defined by the capsule support member 20 also acts as a means to alter and modify favorably, the pickup pattern of the total microphone 10. By combining the present microphone capsule 14 with a capsule support member 20 in accordance with the present invention, a smaller less costly and complicated capsule that can be mounted the flexible rubber capsule support member 20 to significantly reduce handling noise is achieved. In addition, by implementing the construction contemplated in accordance with the present invention, the microphone capsule 14 is much more durable due to electronic components of microphone capsule 14 being mounted in rubber (that is, within the rubber capsule support member 20), so when it is inevitable dropped on the floor, the sensitive electronics of the microphone capsule 14 will not suffer damage. In addition, the construction of the present microphone capsule 14 is less costly and complex than traditional microphone element designs.

As discussed above the top surface 30 of the capsule support member 20 may take three distinct forms. While three distinct surface configurations are discussed in accordance with a preferred embodiment of the present invention, it is appreciated other iterations of the shape of the encapsulation may be used for mounting shapes not disclosed in this document. It is appreciated there are "in betweens" shapes that are also possible without departing from the spirit of the present invention.

By providing a rubber (or other non-porous) support member with a top surface of different shapes the present microphone physically alters the frequency response and polar pickup pattern of the microphone capsule in present microphones to achieve different and usable results; for example, omni, cardioid and supercardioid pick-up patterns (and potentially hypercardiod). It is also appreciated that two or more of these forms can be combined to form multi-pattern angles (for instance a figure eight pick-up pattern) or may be used in conjunction with each other to form stereo pairs or multi channel microphone transducers.

It should be appreciated the top surface 30 may be formed with a perimeter groove or recess to accommodate various grilles that might be used in conjunction with the present invention. For example, and with reference to FIGS. 4 & 5, the top surface 30 of the capsule support member 20 is provided with a perimeter groove 50. However, this groove 50 is actually not a part of the function of the focusing of sound. Rather, it is included so as to allow for the inclusion of a twistable and removable top microphone grille 50. As is appreciated by those skilled in the art, the feet (not shown) of such a removable microphone grille 50, fit in the groove 50 to install it to the housing 12 at a position above the support member 20. The groove has nothing to do with the focusing of sound. Although such a groove is not shown in the other examples discussed below (that is, cardioid and omni) but it could be included with such embodiments where it is desirable to include a removable microphone grille. It is also not necessary to be there in order for the super cardioid version to function correctly. It is simply there for the function of the "pop top" grille.

Figure 2:
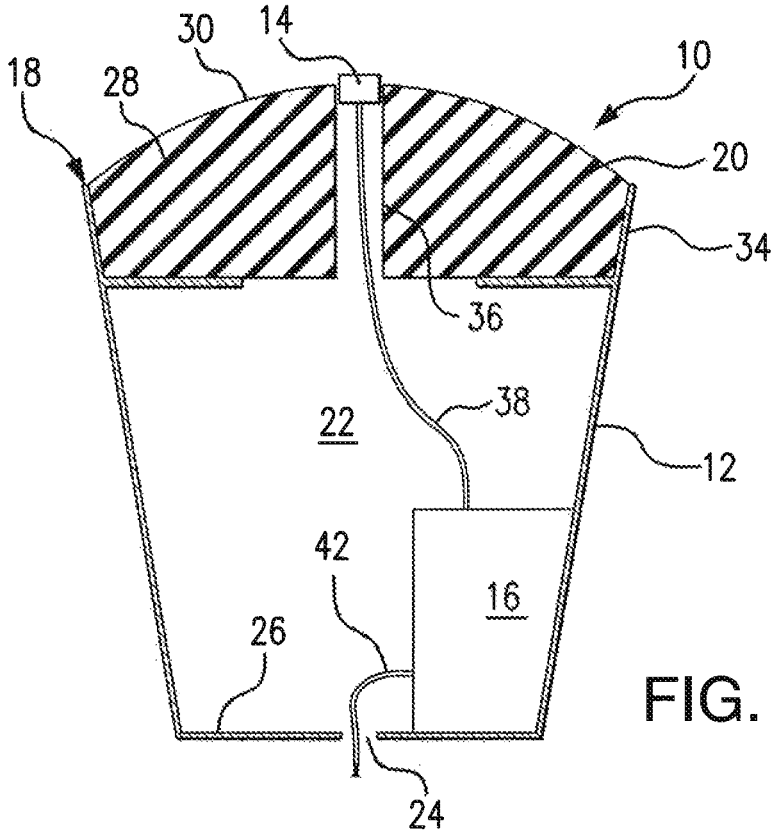
FIGS. 2 and 3 are respectively a cross section view and a perspective view of the microphone in accordance with the present invention wherein the microphone is provided with an omni-directional pick-up pattern.
Figure 3:
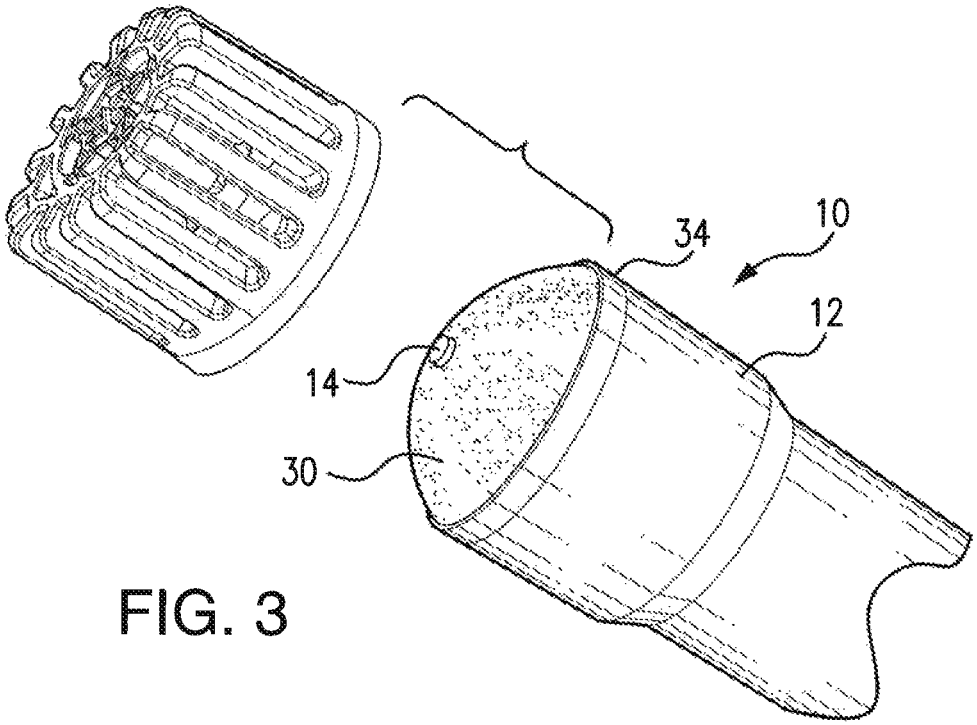

In accordance with a first embodiment, and as shown with reference to FIGS. 2 and 3, an omni-directional microphone is disclosed. When viewed from the side, the top surface 30 of the capsule support member 20 is a convex conical rubber encapsulation in which a small forward facing omni-directional microphone capsule 14 is provided at the apex thereof. In accordance with a preferred embodiment the top surface 30, and with the exception of the central aperture 36 formed in the support member body 28, the top surface 30 is substantially convex having a consistent radius of the curvature along the entire surface. The capsule support member 20 is attached to and pushes outward off the open end 18 of the housing 12 of the microphone 10 while the electronic microphone capsule 14 is mounted in the center of the capsule support member 20 within the central aperture 36.

Figure 4:
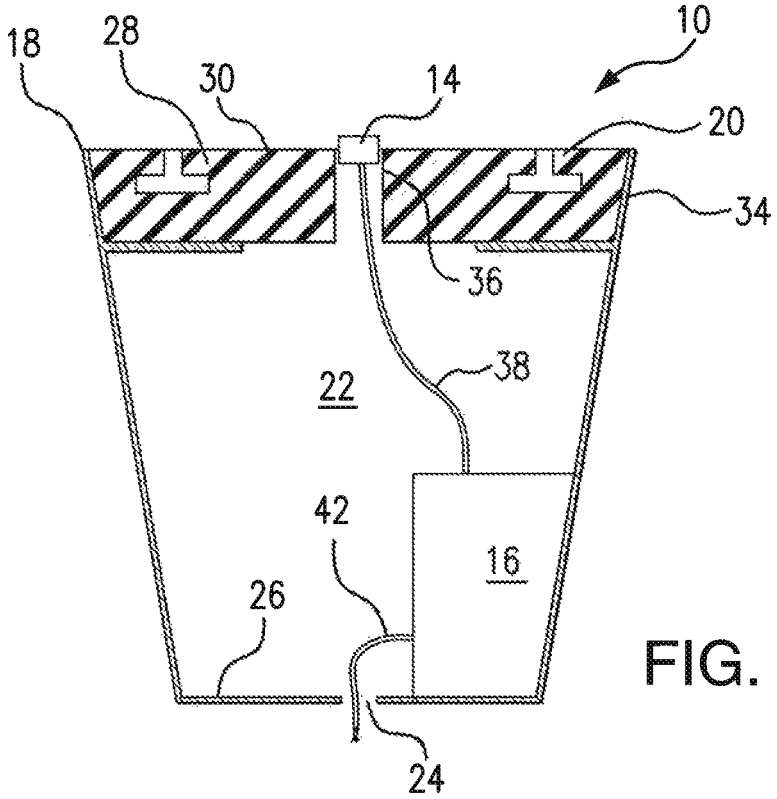
FIGS. 4 and 5 are respectively a cross section view and a perspective view (without the grille) of the microphone in accordance with the present invention wherein the microphone is provided with a cardioid pick-up pattern.
Figure 5:
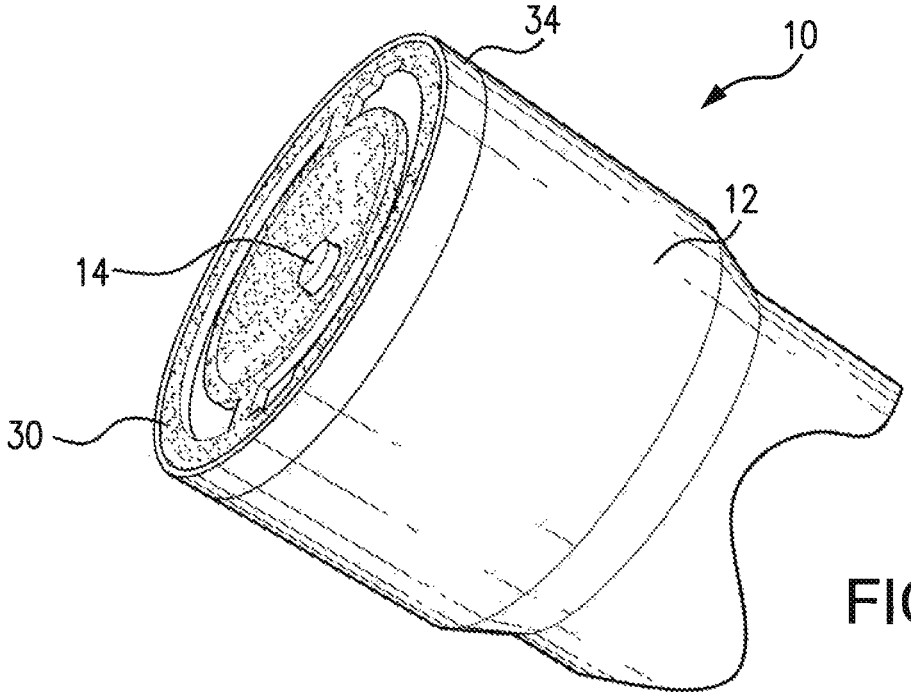

A second embodiment as shown with reference to FIGS. 4 & 5 provides a cardioid directional microphone 10. In accordance with this embodiment, the electronic microphone capsule 14 is mounted in the center of the capsule support member 20 wherein the top surface 30 of the capsule support member 20 is totally flat when viewed from the side. As such, the place in which the top surface 30 lies is substantially parallel to the plane in which the top edges 40 at the open end 18 of the housing 12 lie. As with the prior embodiment, the capsule support member 20 is attached to and pushes outward off the open end 18 of the housing 12 of the microphone 10 while the electronic microphone capsule 14 is mounted in the center of the capsule support member 20 within the central aperture 36.

Figure 6:
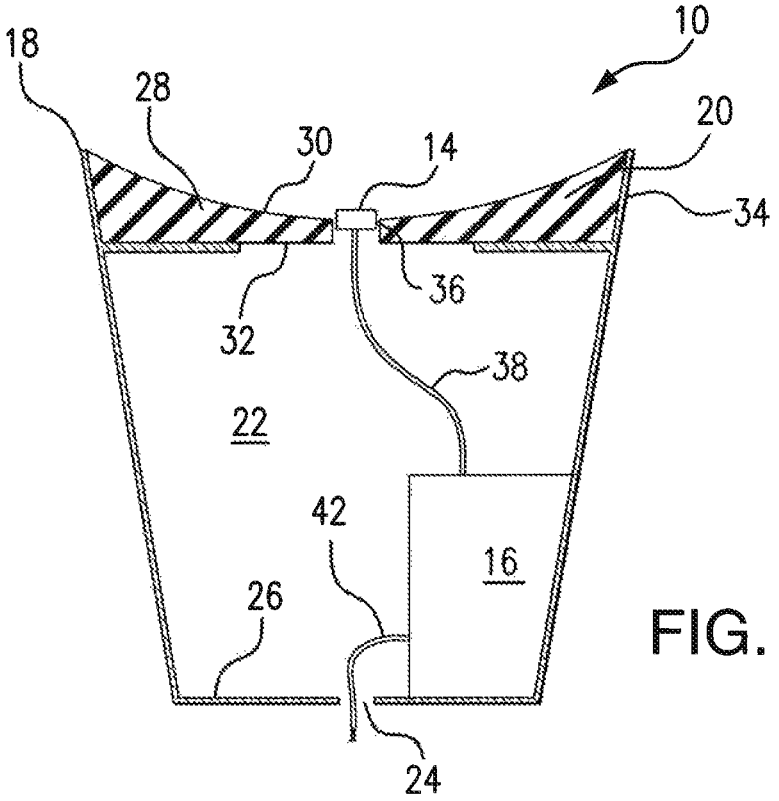
FIGS. 6 and 7 are respectively a cross section view and a perspective view (without the grille) of the microphone in accordance with the present invention wherein the microphone is provided with a supercardioid pick-up pattern.
Figure 7:
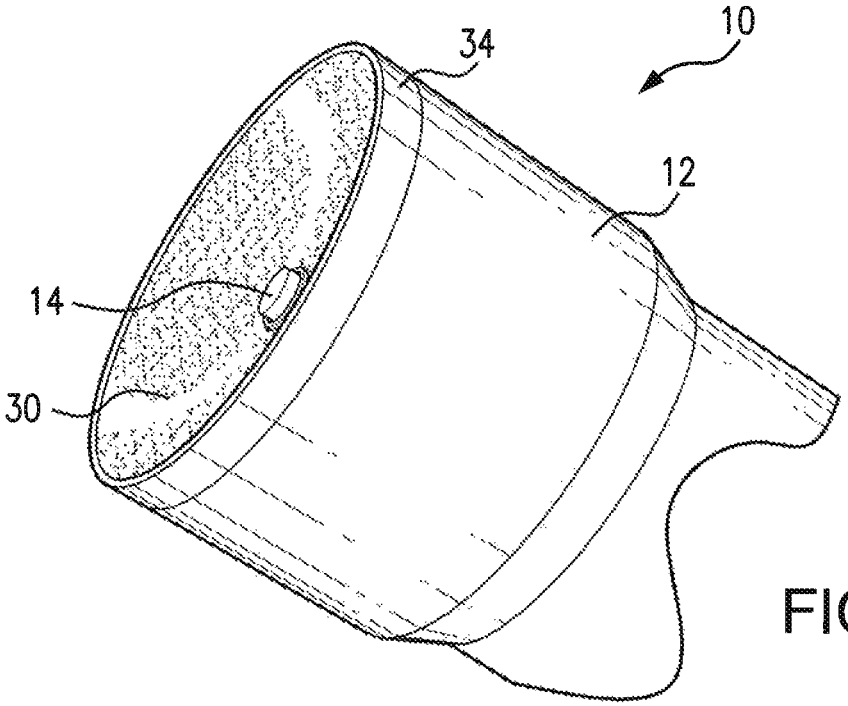

In accordance with third embodiment as shown with reference to FIGS. 6 and 7, a super cardioid directional microphone 10 is provided. When viewed from the side, the top surface 30 of the capsule support member 20 is a concave conical rubber encapsulation in which a small forward facing omni-directional microphone capsule 14 is provided at the bottom of the recess defined by the concavity of the top surface 30. In accordance with a preferred embodiment the top surface 30, and with the exception of the central aperture 36 formed in the support member body 28, the top surface 30 is substantially concave having a consistent radius of the curvature along the entire surface. The capsule support member 20 is attached to and pushes inward off the end of the housing 12 of the microphone 10 while the electronic microphone capsule 14 is mounted in the center on the microphone capsule support member 20.

Figure 8:
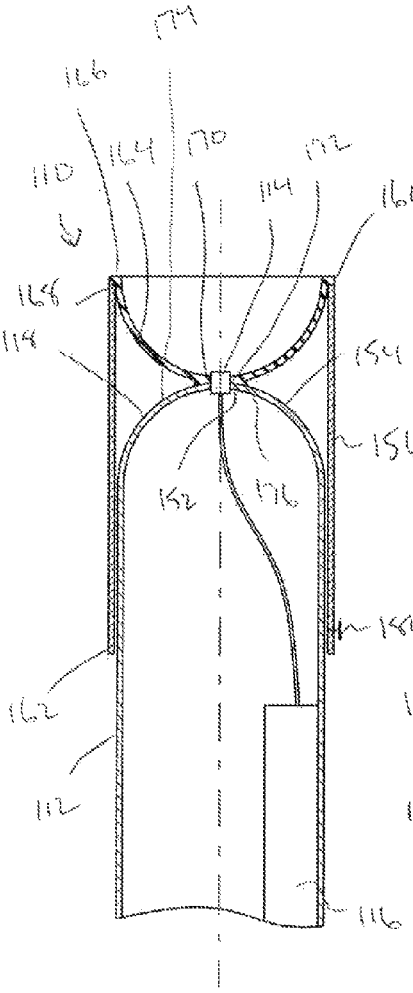
FIGS. 8, 9 and 10 disclose an adjustable embodiment in accordance with the present invention.
Figure 9:
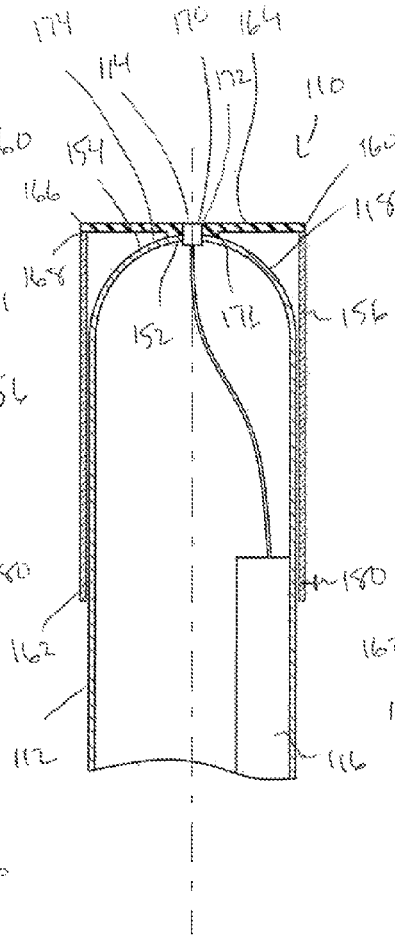
Figure 10:
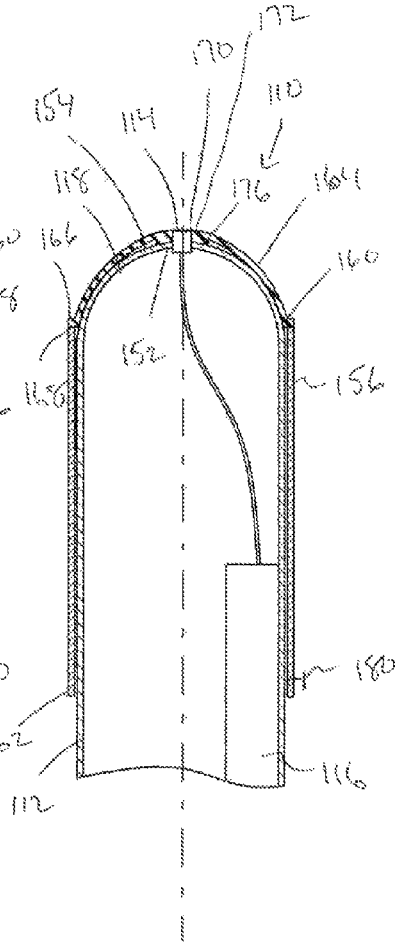

With reference to FIGS. 8 to 10, an alternate embodiment allowing for adjustment of the pickup patterns is disclosed. In accordance with such an embodiment, and as disclosed below in greater detail, the microphone capsule is provided in conjunction with the flexible, rubber support member, that is, the microphone capsule is mounted on a moveable membrane made of non-porous rubber (or other non-porous, elastic, flexible material) that can be moved up and down. The moveable membrane is pushed and pulled from below into a variety of different orientations so as to offer a multitude of different polar pickup patterns and associated frequency responses; that is, a form of physical (non-electronically derived) multi-pattern microphone.

The disclosed embodiment includes a cylindrical housing 112, a microphone capsule 114 positioned within the housing 112, and electronic circuitry 116 transmitting the signal from the microphone capsule 114 to other equipment. As with the prior embodiment, the housing 112 is a substantially hollow cylindrical member having a concave upper end 118 in which the microphone capsule 114 is mounted. The microphone capsule 114 is mounted at the apex 152 of the dome shaped surface 154 defined by the upper end 118 of the housing 112. As with the prior embodiment, the housing 112 further includes a hole (not shown) in its end opposite the upper end 118 thereof for the passage of a wire (not shown) use in connecting the microphone 110 to other equipment.

Positioned about the housing 112 is a profile adjustment member 156. The profile adjustment member 156 is shaped and dimensioned with a diameter slightly larger than the outer diameter 158 of the housing 112 so as to allow for relative movement between the housing 112 and the profile adjustment member 156. As with the housing 112, the profile adjustment member 156 is cylindrical and includes a first end 160 and a second end 162. The first end 160 is covered with a resilient, moveable membrane 164 made of non-porous rubber (or other non-porous, elastic, flexible material) that can be moved up and down as will be explained below in greater detail. The second end 162 of the profile adjustment member 156 is open so as to allow for movement of the housing 112 within the confines of the profile adjustment member 156.

The moveable membrane 164 of the profile adjustment member 156 extends entirely across the opening defined by the first end 160 of the profile adjustment member 156 and the edge 166 of the moveable membrane 164 is secured about the entire circumference of the edge 168 of the profile adjustment member 156 defined at the first end 160 thereof. In this way, the moveable membrane 164 fully covers the first end 160 of the profile adjustment member 156.

The center 170 of the moveable membrane 164 is secured to the apex 152 of the concave upper end 118 of the housing 112 and moves therewith. In particular, a small hole 172 is formed in the center 170 of the moveable membrane 164 through which the microphone capsule 114 extends. The area sounding the small hole 172 is secured to the upper surface 174 of the upper end 118 of the housing 112, for example, with adhesive. In this way, as the profile adjustment member 156 is moved relative to the housing 112, the coupled portions 176 of the moveable membrane 164 and the upper end 118 of the housing 112 remain coupled and move together.

As such, and with reference to FIGS. 8, 9 and 10, relative movement changes the shape of the moveable membrane 164, which in this present embodiment functions in the same manner as the top surface 30 of the capsule support member 20 discussed above with reference to FIGS. 1 to 7. For example, when the profile adjustment member 156 is moved, such that the first end 160 thereof extends above the apex 152 of the upper end 118 of the housing 112, the moveable membrane 164 takes on a concave configuration (see FIG. 8). When the profile adjustment member 156 is moved, such that the first end 160 thereof is substantially aligned with the apex 152 of the upper end 118 of the housing 112, the moveable membrane 164 takes on a substantially flat configuration (see FIG. 9). When the profile adjustment member 156 is moved such that the first end 160 thereof is positioned below the apex 152 of the upper end 118 of the housing 112, the moveable membrane 164 takes on a concave configuration (see FIG. 10). Controlled positioning of the profile adjustment member 156 relative to the housing 112 is achieved using a selective locking mechanism, for example, a set screw 180 extending through the profile adjustment member 156 for selective engagement with the housing 112.

With the foregoing embodiment in mind, it is appreciated the support member may be manufactured in various manners that would allow for adjustment thereof permitting one support member to selectively take the form of a concave orientation, a flat orientation and/or convex orientation.

By mounting the microphone capsule in this manner (that is, within a rubber support member) microphone handling noise is eliminated and excellent vibration isolation is achieved.

As a result of the present microphone construction a smaller less costly and complicated microphone capsule can be mounted in the flexible rubber support member to significantly reduce handling noise while maintaining signal quality and integrity. In this way the microphone capsule becomes much more durable due to electronic components of microphone capsule being mounted in rubber, so when it is inevitable dropped on the floor, the sensitive electronics of the microphone are protected from damage. In addition, the present microphone offers reductions in cost when compared to other microphones.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A microphone, comprising:

a housing;

a microphone capsule positioned within and supported by;

a vibration damping, non-porous capsule support member within the housing; the non-porous capsule support member includes a substantially solid cylindrical support member body having a top surface, a bottom surface and a sidewall extending between the top surface and the bottom surface; and electronic circuitry housed in an internal cavity of the housing for transmitting a signal from the microphone capsule to sound processing equipment.

2. The microphone according to claim 1, wherein the housing is a substantially hollow cylindrical member having an open end shaped and dimensioned for receiving the microphone capsule.

3. The microphone according to claim 2, wherein the capsule support member supports the microphone capsule within the open end of the housing.

4. The microphone according to claim 1, wherein the microphone capsule includes an omni-directional pick-up pattern.

5. The microphone according to claim 1, wherein the microphone is an electret microphone.

6. The microphone according to claim 1, wherein the capsule support member includes an aperture in which the microphone capsule is mounted.

7. The microphone according to claim 6, wherein the central aperture extends through the capsule support member such that it extends from the top surface to the bottom surface so that electrical wires extend from the microphone capsule to the electronic circuitry of the microphone.

8. The microphone according to claim 1, wherein the capsule support member is cylindrical.

9. The microphone according to claim 1, wherein the top surface is convex.

10. The microphone according to claim 1, wherein the top surface is concave.

11. The microphone according to claim 1, wherein the top surface is flat.

12. The microphone according to claim 1, wherein the capsule support member is composed of rubber.

13. The microphone according to claim 1, wherein the housing is a substantially hollow cylindrical member having an open end shaped and dimensioned for receiving the microphone capsule.

14. The microphone according to claim 13, wherein the capsule support member supports the microphone capsule within the open end of the housing.

15. The microphone according to claim 14, wherein the capsule support member includes a support member body having a top surface, a bottom surface and a sidewall extending between the top surface and the bottom surface.

16. The microphone according to claim 15, wherein the capsule support member includes an aperture in which the microphone capsule is mounted.

17. The microphone according to claim 16, wherein the central aperture extends through the capsule support member such that it extends from the top surface to the bottom surface so that electrical wires extend from the microphone capsule to the electronic circuitry of the microphone.

* * * * *